US007690408B2

(12) United States Patent
Sugiura

(10) Patent No.: US 7,690,408 B2
(45) Date of Patent: Apr. 6, 2010

(54) WORKBENCH FOR POWER TOOL

(75) Inventor: Takehiko Sugiura, Anjo (JP)

(73) Assignee: Makita Corporation, Anjo-shi (JP)

( * ) Notice: Subject to any disclaimer, the term of this patent is extended or adjusted under 35 U.S.C. 154(b) by 184 days.

(21) Appl. No.: 11/984,523

(22) Filed: Nov. 19, 2007

(65) Prior Publication Data

US 2008/0115701 A1 May 22, 2008

(30) Foreign Application Priority Data

Nov. 21, 2006 (JP) ..... 2006-314443

(51) Int. Cl.
*B25H 1/04* (2006.01)
*B25H 1/14* (2006.01)

(52) U.S. Cl. ..... 144/286.5; 144/287

(58) Field of Classification Search ..... 144/286.1, 144/286.5, 287; 280/651, 652; 108/118–120
See application file for complete search history.

(56) References Cited

U.S. PATENT DOCUMENTS 2,958,873 A * 11/1960 Ferneau ..... 5/86.1
4,611,823 A 9/1986 Haas
5,927,745 A 7/1999 Cunningham
7,055,847 B2 * 6/2006 Miller et al. ..... 280/638
7,213,829 B2 * 5/2007 Wu ..... 280/645
2001/0047712 A1 12/2001 Kahle
2006/0038383 A1 2/2006 Wu

FOREIGN PATENT DOCUMENTS

JP A 61-188091 8/1986

* cited by examiner

*Primary Examiner*—Shelley Self
(74) *Attorney, Agent, or Firm*—Oliff & Berridge, PLC

(57) ABSTRACT

It is an object of the invention to provide a technique to improve usability of a workbench for a power tool. To achieve the object, a representative workbench for a power tool is provided with a table, first and second supports, a shaft, a handle body, a handle, a lock mechanism and a lock release member. The lock release member includes an elongated element disposed below the upper surface of the table and extending along the table toward the handle, and the lock of the table is released when the user pulls the elongated element in the longitudinal direction of the elongated element. According to the invention, the user can release the lock of the table simply by pulling the elongated element, so that ease of lock releasing operation is enhanced.

7 Claims, 10 Drawing Sheets

WORKBENCH FOR POWER TOOL

BACKGROUND OF THE INVENTION

1. Field of the Invention

The present invention relates to a workbench for a power tool which is suitable as workbench to place a stationary power tool such as a desk circular saw.

2. Description of the Related Art

Japanese laid-open patent publication No. 61-188091 discloses a technique relating to a workbench. In this workbench, a support leg is formed of two frames crossed in an X-shape and rotatably connected at the intersection such that it can be collapsed, and a table for mounting a machine is supported by the support leg. The table is moved between a lower position and an upper position while being kept in a horizontal position when the frames are rotated between a collapsed position in which the frames are disposed close to each other in the vertical direction and an open leg position in which the frames are disposed obliquely to each other. The table is then locked by a lock mechanism in the position in which the table is placed.

In the lock mechanism according to the above-described known workbench, a claw mounted on the underside of the table is engaged from above with an upper end portion of one of the frames which can slide horizontally with respect to the underside of the table, so that the table is locked. The lock is released when the user operates the claw by a finger. However, with the construction in which the claw is disposed on the underside of the table, the user needs to reach under the table and operate the claw in a blind way with the finger. This operation is cumbersome and further improvement is desired.

SUMMARY OF THE INVENTION

Accordingly, it is an object of the invention to provide a technique to improve usability of a workbench for a power tool.

The above-described object is achieved by the claimed invention. According to the invention, a representative workbench for a power tool is provided to include a table on which the power tool is placed, and a first support leg having an upper end rotatably mounted on one end side of the table and a lower end. The first support leg extends downward toward the other end side of the table from the upper end to the lower end. Further, a second support leg has an upper end and a lower end and the upper end is mounted on the other end side of the table in such a manner as to be horizontally movable with respect to the table. The second support leg extends downward toward the one end side of the table from the upper end to the lower end and intersects with the first support leg.

A shaft rotatably connects intersections of the first and second support legs. A handle is designed to be held by an user and disposed on the other end side of the table. When the user raises or lowers the handle, the first and second support legs rotate on the shaft, so that the table is moved vertically while horizontally moving with respect to the upper end of the second support leg.

The workbench according to this invention includes a lock mechanism that prevents the upper end of the second support leg and the table from moving with respect to each other in a direction to lower the table when the table is moved between a lower position of a predetermined height and a predetermined upper position higher than the lower position, thereby locking the table in the upper position, and a lock release member that releases the table locked by the lock mechanism. The lock release member includes an elongated element disposed below the upper surface of the table and extending along the table toward the handle, and the lock of the table is released when the user pulls the elongated element in the length direction of the elongated element.

The lower position typically corresponds to a collapsed position in which the first and second support legs are collapsed in such a manner as to be disposed close to each other in the vertical direction. Further, the upper position may correspond to a working position in which the user performs a particular operation by using the power tool placed on the table. When the representative workbench is used, the user moves the table from the lower position to the upper position by lifting the handle and then locks the table in that upper position by the lock mechanism.

In this state, the user can perform a particular operation by using the power tool placed on the table. After the end of the operation, by pulling the elongated element, the user can release the lock of the table and lower the table from the upper position to the lower position. The elongated element typically corresponds to an arm formed, for example, of a rod-like material, but it may be formed of other material such as a wire rope. In the former, a grip to be held by the user may preferably be formed on an extending end of the elongated element to extend in a direction that intersects with the extending direction of the elongated element.

According to the invention, the lock of the table is released by pulling the elongated element of the lock release member. Specifically, the user can release the lock of the table simply by pulling the elongated element, so that ease of lock releasing operation is enhanced. Further, with the construction in which the elongated element is pulled in the length direction, interference of the elongated element with other members existing around the elongated element is avoided. Further, not only the weight of the table but the weight of the power tool acts as downward load upon the table placed in the upper position. In this invention, the elongated element extends toward the handle so that the user can hold the handle, for example, with one hand and pulls the elongated element with the other hand. In other words, the user can support the downward load acting on the table by holding the handle and can thereby prevent the table from abruptly lowering when the lock is released.

Further, with the construction in which the elongated element is disposed below the upper surface of the table and extends along the table, the elongated element can be installed in a limited space in the vertical direction. As a result, the table lowered to the lower position can be reduced in the height from the ground, which is effective in storage of the power tool workbench. Further, with the construction in which the elongated element is disposed below the upper surface of the table, the elongated element never interferes with operation of the power tool on the table.

Other objects, features and advantages of the present invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide improved workbench for power tool and method for using such workbench for power tool and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

Figure 1:
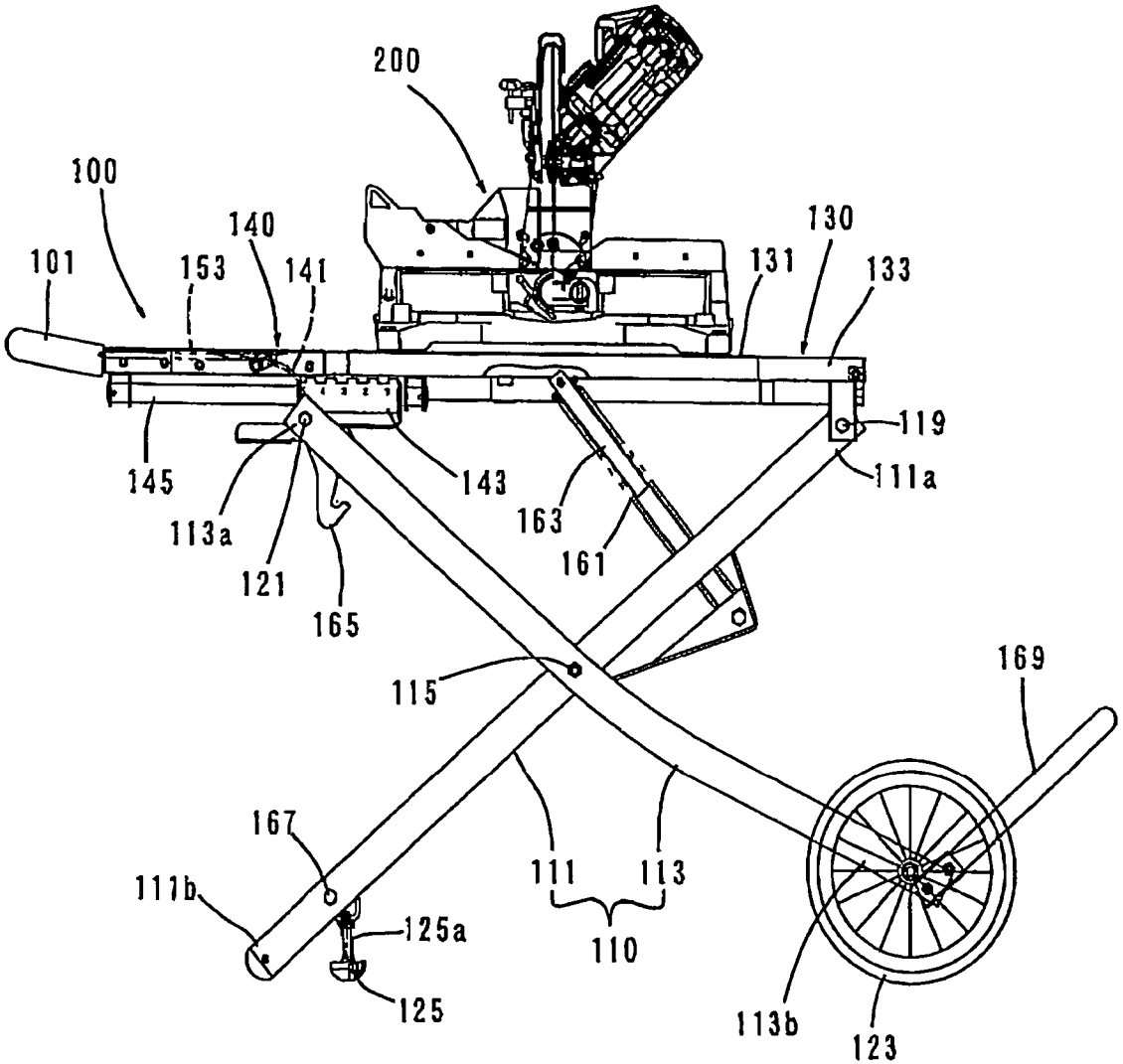
FIG. 1 is a side view showing an entire workbench according to a representative embodiment of the invention, in the state in which a table is placed in a raising end position in which the table is located in the highest vertical position from the ground.
Figure 2:
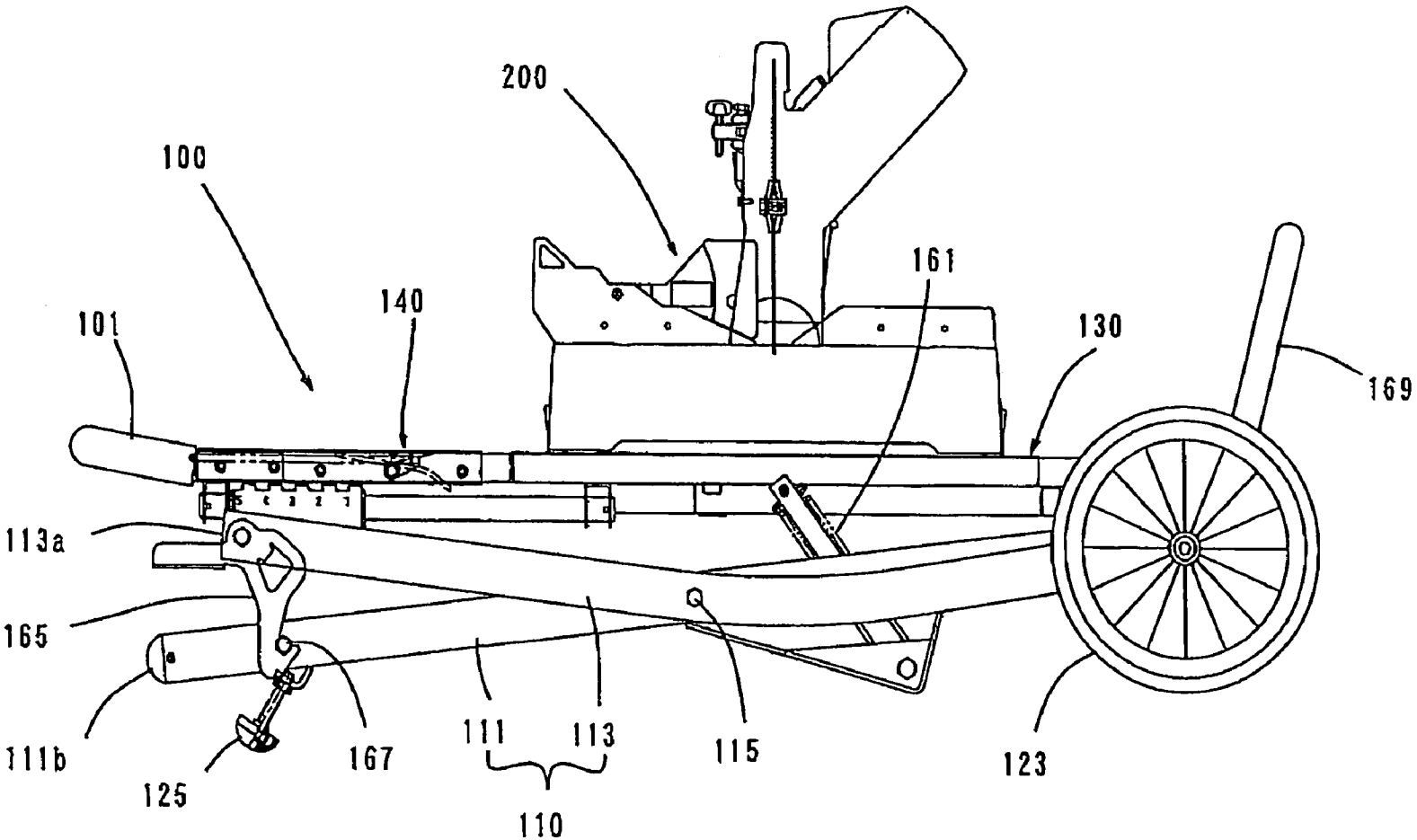
FIG. 2 is a side view showing the entire workbench, in the collapsed state in which the table is placed in a lowering end position in which the table is located in the lowest vertical position from the ground.
Figure 3:
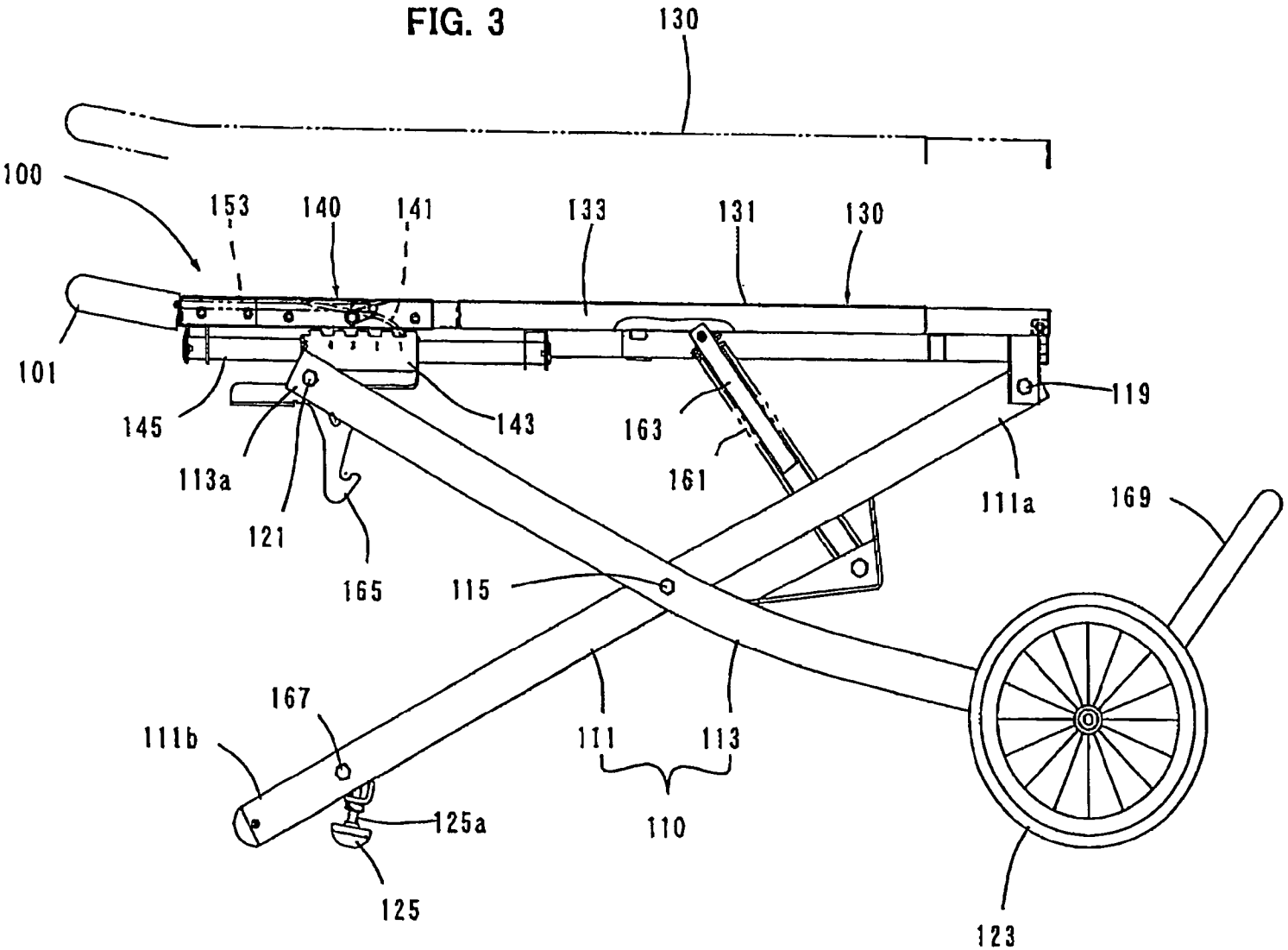
FIG. 3 is a side view showing the entire workbench, in the state in which the table is placed in an intermediate position in which the table is located in a lower vertical position than the raising end position.
Figure 4:
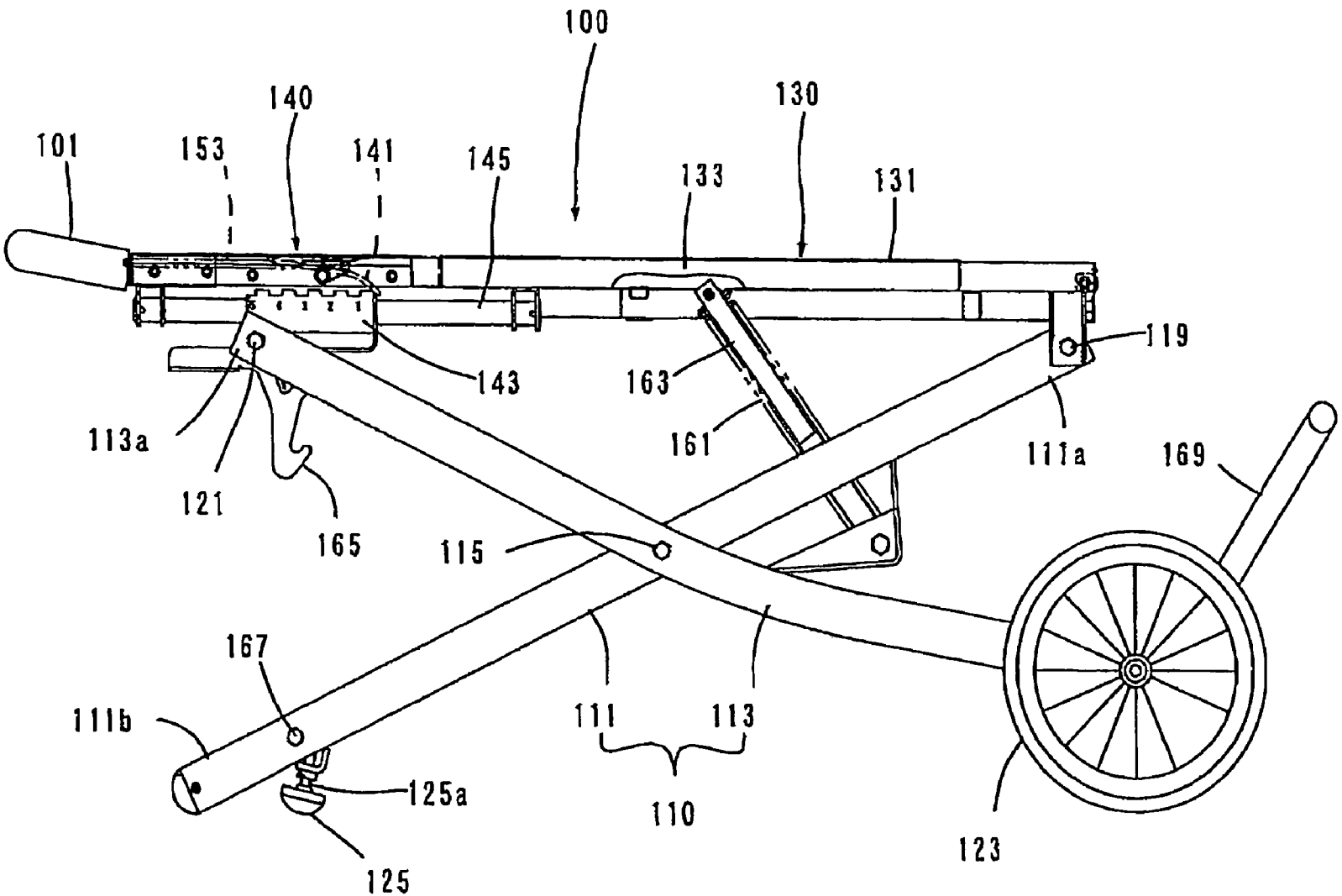
FIG. 4 is a side view showing the entire workbench, in the state in which the table is held at the limit of the action of a compression coil spring for assisting in raising the table.
Figure 5:
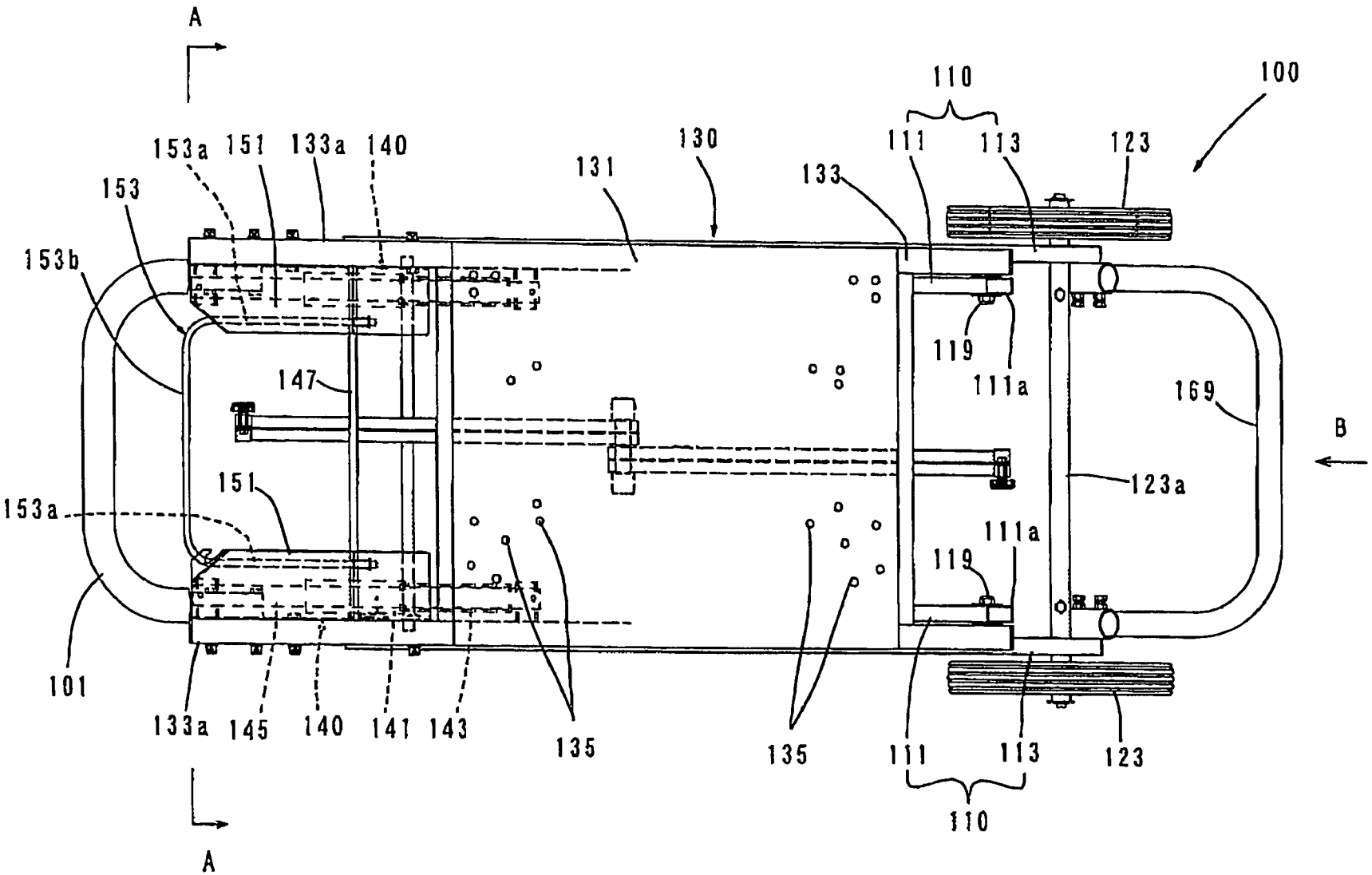
FIG. 5 is a plan view showing the entire structure of the workbench.
Figure 6:
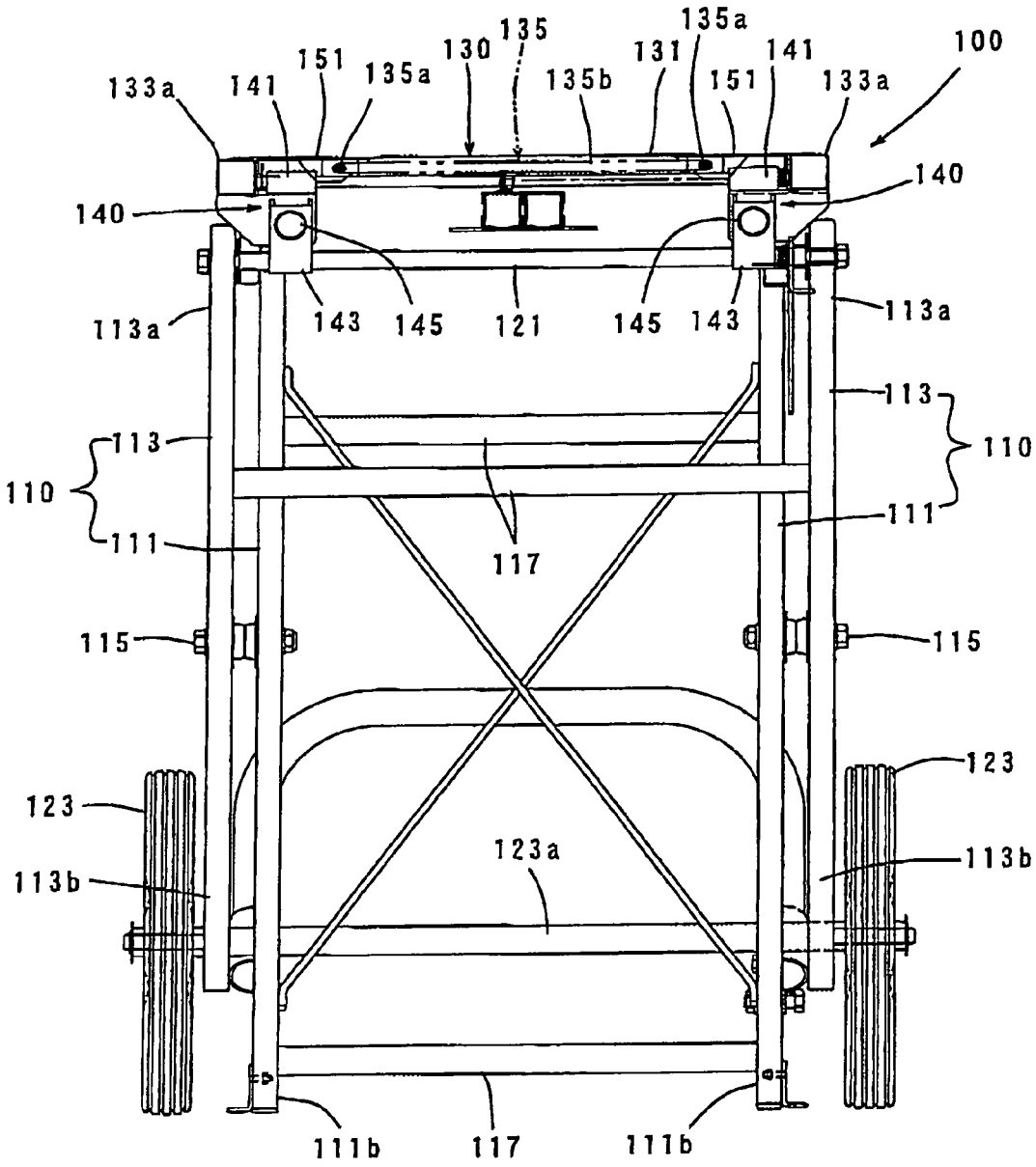
FIG. 6 is a sectional view taken along line A-A in FIG. 5.
Figure 7:
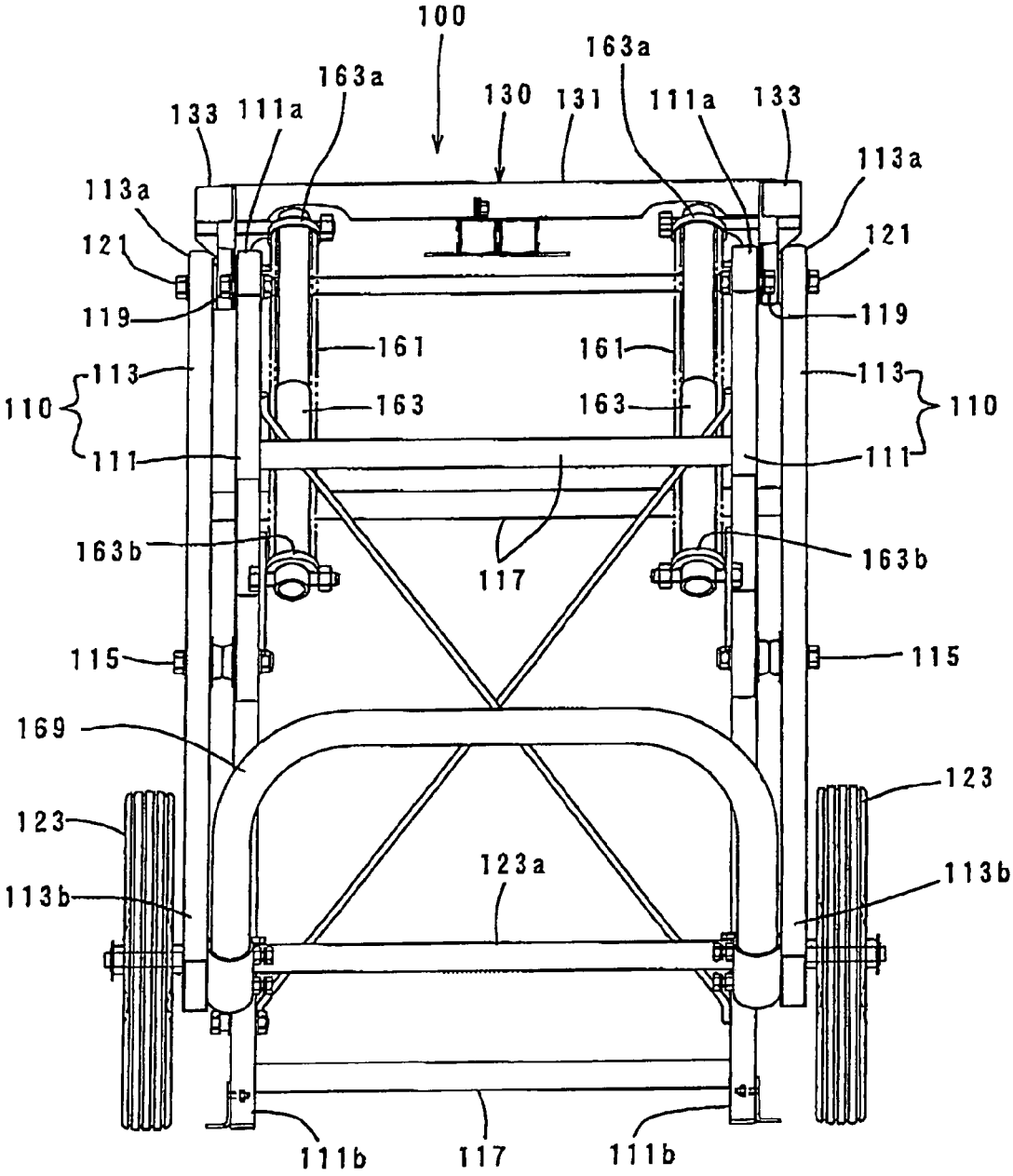
FIG. 7 is a view as viewed from the direction of arrow B in FIG. 5.
Figure 8:
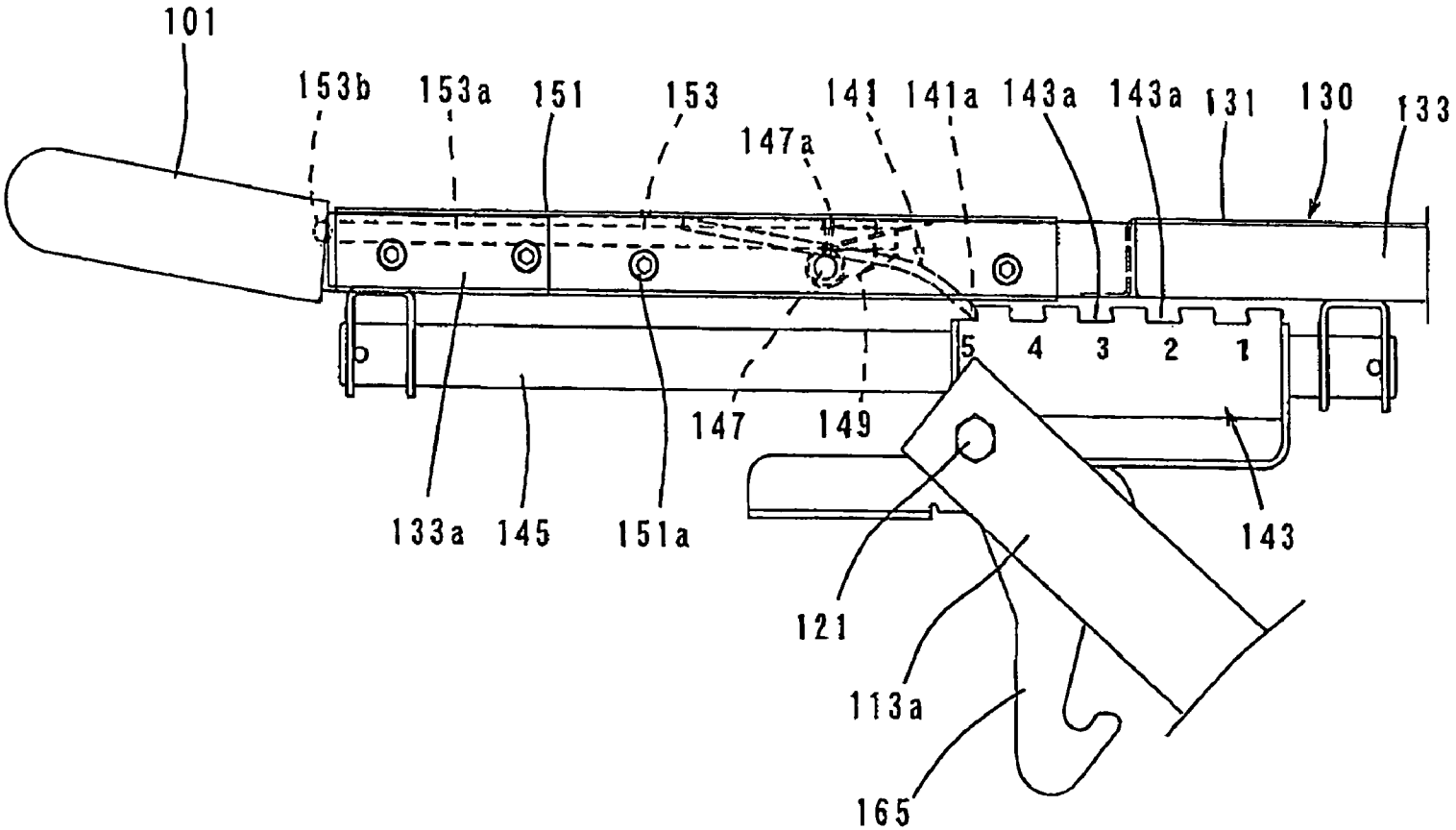
FIG. 8 is a plan view showing the structure of a lock mechanism.
Figure 9:
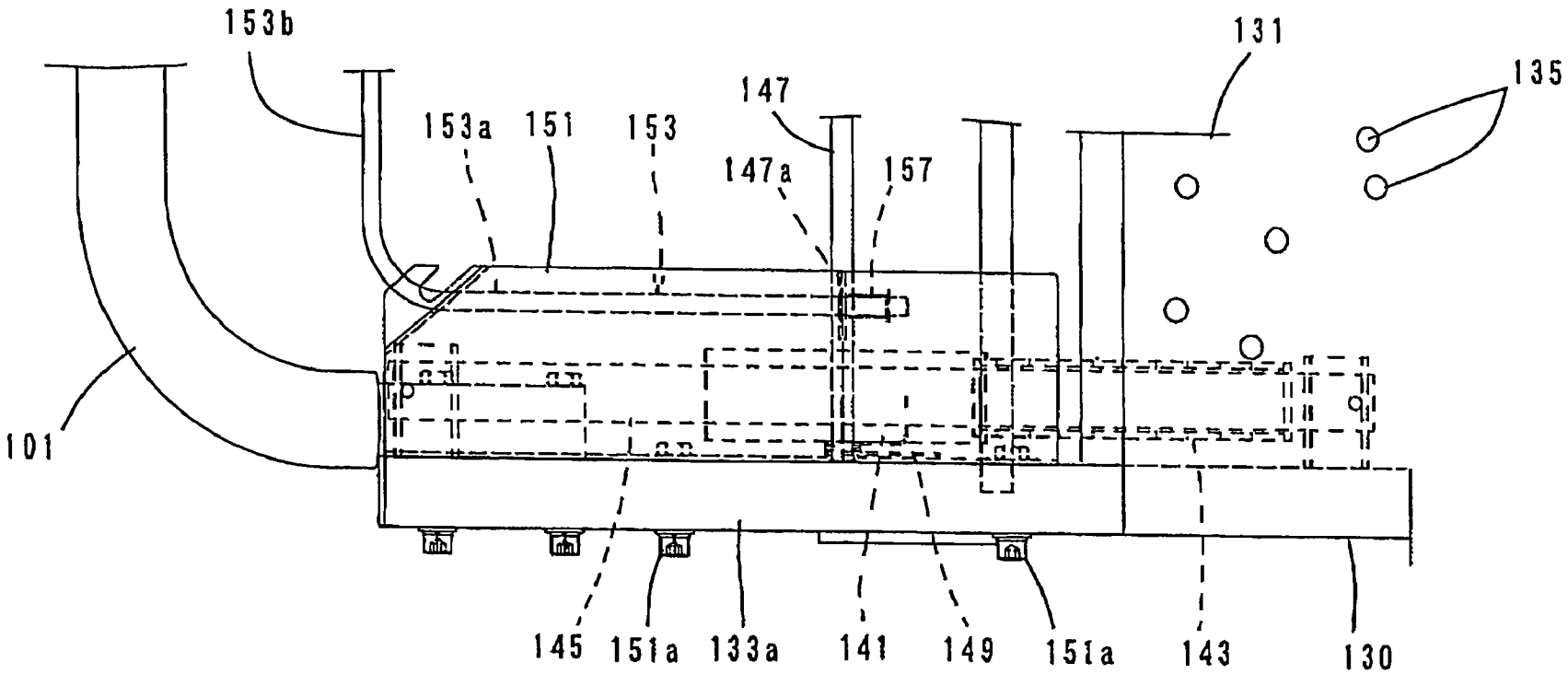
FIG. 9 is a side view showing the structure of the lock mechanism.
Figure 10:
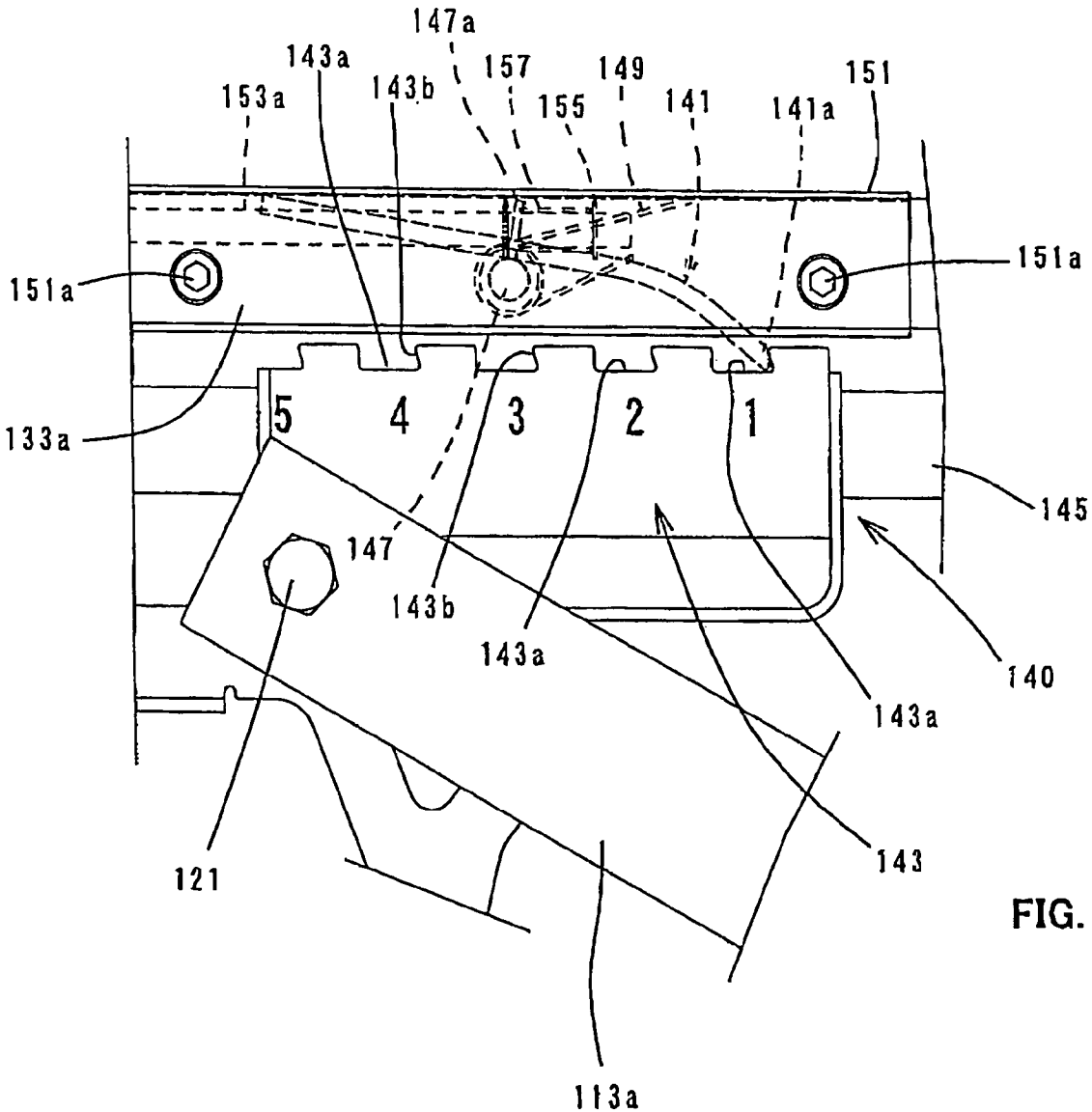
FIG. 10 is an enlarged side view showing the structure of the lock mechanism.

A representative embodiment of the invention is now described with reference to the drawings. A workbench for a power tool according to this embodiment is embodied as a collapsible workbench for a desk circular saw. FIGS. 1 to 4 are side views each showing an entire workbench 100 of this embodiment. Specifically, FIG. 1 shows the state in which a table 130 is placed in a raising end position in which the table 130 is located in the highest vertical position from the ground. FIG. 2 shows the collapsed state in which the table 130 is placed in a lowering end position in which the table 130 is located in the lowest vertical position from the ground. FIG. 3 shows the state in which the table 130 is placed in an intermediate position in which the table 130 is located in a lower vertical position than the raising end position. Further, FIG. 4 shows the state in which the table 130 is held at the limit of the action of a compression coil spring 161 for assisting in raising the table 130. A desk circular saw 200 is shown placed on the table 130 in FIG. 1, but it is not shown in the other drawings. FIG. 5 is a plan view showing the entire structure of the workbench 100. FIG. 6 is a sectional view taken along line A-A in FIG. 5. FIG. 7 is a view as viewed from the direction of arrow B in FIG. 5. FIGS. 8 to 10 show a lock mechanism 140 in detail.

As shown in FIGS. 1 to 7, the workbench 100 includes a generally rectangular table 130 on which the desk circular saw 200 is to be placed, support legs 110 for supporting the table 130, a handle 101 that is mounted to the table 130 and designed to be held by user, and a lock mechanism 140 that locks the table 130 in several work positions which are different in vertical height from the ground. The table 130 and the handle 101 correspond to the "table" and the "handle", respectively, according to this invention. The side of the handle 101 (the left side as viewed in FIG. 1) is taken as the front side, and its opposite side is taken as the rear side.

The table 130 includes a rectangular plate 131 elongated in the longitudinal direction and having a flat placing surface to place the desk circular saw 200, and frames 133 fixedly mounted on and extending along the side edges of the underside of the plate 131. A plurality of appropriately spaced-apart mounting holes 135 (see FIG. 5) for fastening the desk circular saw 200 are provided in the plate 131 of the table 130. In order to fasten the desk circular saw 200 to the table 130, although not shown, mounting holes formed on the side of the desk circular saw 200 are aligned with the mounting holes 135 on the upper surface of the table 130, and bolts are inserted through the mounting holes and tightened with nuts. Therefore, the desk circular saw 200 can be demounted from the table 130 by unscrewing the bolts and nuts, as necessary. Further, the handle 101 is disposed in front of the right and left frames 133 of the table 130. As shown in FIG. 5, the handle 101 is generally U-shaped in plan view and horizontally disposed between the frames 133, and the ends of the U-shaped handle 101 are joined to the front ends of the frames 133.

The support legs 110 for supporting the table 130 are comprised of a pair of the right and left support legs 110. Each of the support legs 110 have two frames 111, 113 crossed in an X-shape and rotatably connected at the intersection via a pivot shaft 115. The frames 111, 113 can vertically pivot on the pivot shaft 115 with respect to each other. At this time, the table 130 is moved vertically. The pivot shaft 115 is a feature that corresponds to the "shaft" according to this invention. The frames 111, 113 are formed of an iron square pipe. As shown in FIGS. 6 and 7, laterally opposed frames 111, 113 are integrally connected to each other by connecting rods 117 and thus reinforced.

An upper end 111*a* of the first frame 111 is rotatably mounted on the underside of the rear end of the table 130 via an upper pivot shaft 119. The first frame 111 extends forward and downward of the table 130 from the upper end 111*a* to a lower end 111*b*, and the lower end 111*b* of the frame 111 is grounded (on the ground or floor). As shown in FIG. 7, the upper pivot shaft 119 also serves as a connecting member for connecting the opposed right and left frames 111 together. Each of the right and left frames 133 of the table 130 has an extension 133*a* extending further forward from the front end of the plate 131. A sliding member 143 is mounted on the underside of the extension 133*a* of each of the frames 133 and can move in the longitudinal direction with respect to the frame 133 via a guide rod 145. An upper end 113*a* of each of the second frames 113 is rotatably mounted on the sliding member 143 via an upper pivot shaft 121.

Specifically, the upper end 113*a* of the second frame 113 can horizontally move with respect to the table 130 on the underside of the front end side of the table 130. The second frame 113 extends rearward and downward of the table 130 from the upper end 113*a* to a lower end 113*b*, and a wheel 123 is mounted on the lower end 113*b* of the second frame 113. As shown in FIGS. 6 and 7, an axle 123*a* of the wheel 123 also serves as a connecting member for connecting the opposed right and left frames 113 together. The rear end side and the front end side of the table 130 are features that correspond to the "one end side of the table" and the "other end side of the table", respectively, according to this invention. Further, the first frame 111 and the second frame 113 are features that correspond to the "first support leg" and the "second support leg", respectively, according to the invention.

When the support legs 110 are collapsed, or when the decussated frames 111, 113 are rotated downward on the pivot shaft 115, the table 130 is placed in the lowering end position in which the table 130 is located in the lowest vertical position from the ground. This state is shown in FIG. 2. The lowering end position corresponds to the "lower position" according to this invention. When the user stands on the side facing the handle 101 and lifts the handle 101, the decussated frames 111, 113 are rotated upward on the pivot shaft 115. Thus, the table 130 can be raised.

FIG. 1 shows the table 130 in the raising end position in which the table 130 is located in the highest vertical position from the ground. The raising end position corresponds to the "upper position" according to this invention. When the table 130 is raised and lowered between the raising end position and the lowering end position, the upper end 113*a* of the second frame 113 of each of the support legs 110 moves horizontally with respect to the table 130 via the sliding member 143. At this time, the wheel 123 mounted on the lower end 113*b* of the second frame 113 rolls on the ground, so that this relative movement of the upper end 113*a* can be smoothly performed.

In This representative embodiment, the workbench 100 is provided with a lock mechanism 140 that can lock the table 130 in the raising end position and in an intermediate position between the raising end position and the lowering end position. The intermediate position corresponds to the "intermediate position" according to this invention. The lock mechanism 140 of this embodiment can lock the table 130 at several levels (five levels in this embodiment) including the upper end position in its vertical position from the ground. In other words, with the lock mechanism 140, the vertical height of the table 130 can be adjusted in several levels. The construction of the lock mechanism 140 is now be explained with reference to FIGS. 8 to 10.

The lock mechanism 140 is configured to lock the upper end 113*a* of the second frame 113 against relative movement with respect to the table 130 in the direction of downward movement of the table 130. The lock mechanism 140 includes right and left lock claws 141 arranged on the front side of the table 130, and the above-mentioned right and left sliding members 143 that move horizontally with respect to the table 130 together with the upper end 113*a* of the second frame 113. The lock claws 141 and the sliding members 143 are features that correspond to the "engaging members" and the "movable elements", respectively, according to this invention.

Right and left guide rods 145 are disposed on the underside of the extensions 133*a* of the right and left frames 133 and extend horizontally in the longitudinal direction along the frames 133. The sliding members 143 are slidably mounted along the guide rods 145. Generally U-shaped five lock grooves 143*a* are formed in the upper surface of each of the sliding members 143 and arranged at predetermined intervals in the direction of travel of the sliding member 143. A tip (rear end) 141*a* of the lock claw 141 is placed in selected one of the lock grooves 143*a* and engaged with an engagement wall surface 143*b* of the lock groove 143*a*. In this manner, the sliding members 143 are prevented from sliding forward (leftward as viewed in FIGS. 8 to 10) and the table 130 is locked against downward movement. Thus, the height of the table 130 can be adjusted in five levels. The lock grooves 143*a* are features that correspond to the "engagement recesses" according to the present invention.

The right and left lock claws 141 are formed like an arm, disposed above the right and left sliding members 143 and extending in the longitudinal direction. Each of the lock claws 141 is connected, at about the midpoint in the longitudinal direction, to the extension 133*a* of the associated frame 133 via a rotating shaft 147 in such a manner as to vertically rotate. The rotating shaft 147 extends between the right and left frames 133 of the table 130. The axial ends of the rotating shaft 147 are rotatably mounted to the frames 133, and the right and left lock claws 141 are fixedly mounted on the rotating shaft 147. Specifically, the right and left lock claws 141 rotate together with the rotating shaft 147. When each of the lock claws 141 rotates downward (clockwise as viewed in FIG. 8), the rotating end or the claw tip 141*a* is placed in selected one of the lock grooves 143*a* of the sliding member 143 and engaged with the engagement wall surface 143*b* of the lock groove 143*a*. On the other hand, when the lock claw 141 rotates upward, the claw tip 141*a* is disengaged from the lock grooves 143*a*.

Further, each of the lock claws 141 is urged by a torsion spring 149 in the direction of engagement with the lock grooves 143*a*. The torsion spring 149 is a feature that corresponds to the "elastic member" according to this invention. One end of the torsion spring 149 is locked by the associated lock claw 141, and the other end is locked by a cover plate 151. The cover plate 151 is arranged in such a manner as to cover the guide rod 145, the sliding member 143 and the lock claw 141 from above and fastened to the extension 133*a* of the frame 133 by a bolt 151*a*. When the claw tip 141*a* is placed in one of the lock grooves 143*a* and engaged with the engagement wall surface 143*b*, the other end (front end) of the lock claw 141 on the side opposite to the claw tip 141*a* contacts the underside of the cover plate 151. In this state, the lock claw 141 is prevented from being further rotated in the direction of engagement by the torsion spring 149. The upper surface of the cover plate 151 is generally flush with the upper surface of the table 130 or the upper surface of the plate 131.

Further, as shown in FIGS. 8 to 10, the engagement wall surface (rear wall surface) 143*b* of the lock groove 143*a* which is engaged with the tip 141*a* of the lock claw 141 is inclined in the direction that narrows the open top of the lock groove 143*a*. Therefore, when the claw tip 141*a* is engaged with the engagement wall surface 143*b*, the claw tip 141 a contacts the engagement wall surface 143*b* from the direction that intersects with the direction of disengagement or upward rotation of the claw tip 141. At the same time, the weight of the table 130 acts in a direction of holding this engagement. Therefore, this engagement is held unless the table 130 is lifted.

A release arm 153 for lock release is provided in the lock mechanism 140 and designed to be pulled by the user. The release arm 153 is a feature that corresponds to the "lock release member" according to the invention. As shown in FIG. 5, the release arm 153 is generally U-shaped in plan view and disposed between the extensions 133*a* of the right and left frames 133. Specifically, the release arm 153 includes two rod-like portions 153*a* extending along the extensions 133*a* of the right and left frames 133, and a connecting portion 153*b* connecting the rod-like portions 153*a*. The ends of the rod-like portions 153*a* are connected to the rotating shaft 147 that supports the right and left lock claws 141. The rod-like portions 153*a* are features that correspond to the "elongated element" according to the present invention. Right and left plates 147*a* are provided on the rotating shaft 147 and extend vertically upward from the top of the outer surface of the rotating shaft 147. The ends of the rod-like portions 153*a* of the release arm 153 are passed through the associated plates 147*a* and can slide in the longitudinal direction. Further, a ring 155 is provided on the passed-through end of each of the rod-like portions 153*a*, and a coil spring 157 is disposed between the ring 155 and the plate 147*a* on the passed-through end. The coil spring 157 is fitted over the end of the rod-like portion 153*a*. One end of the coil spring 157 contacts the ring 155, and the other end contacts the plate 147*a*. Specifically, when the release arm 153 is pulled, the pull force is transmitted to the rotating shaft 147 via the coil spring 157. The coil spring 157 is a feature that corresponds to the "elastic element" according to the present invention.

The release arm 153 is arranged to extend toward the handle 101 (forward) along the undersides of the right and left cover plates 151, and the connecting portion 153*b* extending laterally at the extending end forms a grip to be held by an user. The connecting portion 153*b* is hereinafter referred to as a grip. The grip 153*b* of the release arm 153 is located at the rear of the handle 101 and extends parallel to the handle 101. The grip 153*b* is located so close to the handle 101 that the user standing facing the handle 101 can hold the handle 101 and the grip 153*b* at the same time with one hand.

Each of the right and left compression coil springs 161 is mounted between the table 130 and the associated right or left first frame 111 and serves to assist in raising the table 130. The compression coil spring 161 is a feature that corresponds to the "biasing member" according to the present invention. The compression coil spring 161 is disposed over a telescopic, cylindrical member 163 formed by an inner cylinder and an outer cylinder. One end of the compression coil spring 161 is received by a spring receiver 163*a* provided on the inner cylinder, and the other end is received by a spring receiver 163*b* on the outer cylinder. One end of the inner cylinder of the cylindrical member 163 is rotatably supported by the table 130, and one end of the outer cylinder of the cylindrical member 163 is rotatably supported by the free 111. Therefore, the compression coil spring 161 expands or contracts when the table 130 is raised or lowered. The compression coil spring 161 assists in raising the table 130 when the table 130 is raised by the user, while it prevents the table 130 from being abruptly lowered when the table 130 is lowered by the user.

When the table 130 is moved between the raising end position and the lowering end position, the installation length of the compression coil spring 161 changes and/or the spacing between the spring receivers 163*a*, 163*b* changes. In this embodiment, the compression coil spring 161 installed between the table 130 and the associated right or left first frame 111 is arranged such that the spacing between the spring receivers 163*a*, 163*b* corresponds to the free length of the compression coil spring 161 when the table 130 is placed in a position slightly below the lowest level of the intermediate position. Therefore, when the table 130 is placed in the range between the lowering end position and the boundary (the position shown in FIG. 4) between a lock disabled region in which the table 130 cannot be locked by the lock mechanism 140 and a lockable region in which the table 130 can be locked by the lock mechanism 140, the spacing between the spring receivers 163*a*, 163*b* narrows. As a result, the compression coil spring 161 is held under load conditions in which it receives a downward load of the table 130. When the table 130 is placed in a height adjustable region in which the table 130 can be locked in a selected height position, the spacing between the spring receivers 163*a*, 163*b* widens. As a result, the compression coil spring 161 is held under no-load conditions (in a free-length state) in which it does not receive the downward load of the table 130. Further, the ends of the compression coil spring 161 contact at least one of the spring receivers 163*a*, 163*b* in a non-fixed state or in a disengageable manner.

A hook 165 is provided on each of the support legs 110 and used to hold the table 130 in the lowering end position. The hook 165 is rotatably mounted on the second frame 113. When the support legs 110 are collapsed and the table 130 is placed in the lowering end position, the hook 165 can be engaged with a pin 167 provided on the first frame 111, for example, by turning with the user's fingers or foot. Thus, the support legs 110 can be locked in the collapsed state. Further, an auxiliary stand 169 is provided on the lower end 113*b* of the second frame 113 and used to set the collapsed workbench 100 against a wall or the like for storage.

Usage of the workbench 100 constructed as described above is now be described. FIG. 2 shows the workbench 100 in the state in which the table 130 is placed in the lowering end position. In this state, the user disengages the hook 165 from the pin 167. Subsequently, the user grips the handle 101 and pulls and lifts it, while holding the lower end 111*b* of the first frame 111 with one foot. As a result, the crossed frames 111, 113 forming the support leg 110 rotate on the pivot shaft 115, so that the table 130 is raised. This lifting operation is assisted by the biasing force of the compression coil spring 161 until the table 130 is raised from the lowering end position close to the first level of the intermediate position as shown in FIG. 4. Therefore, the user can easily lift the table 130.

When the table 130 is raised, the upper end 113*a* of the second frame 113 moves rearward (rightward as viewed in FIGS. 8 to 10) with respect to the table 130 together with the sliding member 143. Thereafter, when the table 130 is further raised, the tip 141*a* of the lock claw 141 climbs on the upper surface of the sliding member 143 against the biasing force of the torsion spring 149 and slides on the upper surface and into the first lock groove 143*a* from the sliding rear end. Then, the tip 141*a* of the lock claw 141 engages the engagement wall surface 143*b*. This state is shown in FIG. 3. When the handle 101 is further raised from this state, the tip 141*a* of the lock claw 141 is disengaged from the first lock groove 143*a* and climbs on the upper surface of the sliding member 143. Then, the tip 141*a* of the lock claw 141 engages in the second lock groove 143*a*. Such movement can be repeated until the table 130 is lifted to the raising end position shown in FIG. 1. When the user stops lifting the table 130 on its way, the tip 141*a* of the lock claw 141 engages in the lock groove 143*a* located in that position. As a result, the forward movement of the sliding member 143 with respect to the table 130 is prevented so that the table 130 is locked against lowering. Specifically, according to this invention, the table 130 can be adjusted for easy operation to an optimum height selected from five levels including the raising end position. Thus, the desk circular saw 200 can be used to cut a workpiece on the height-adjusted table 130.

In the locked state of the table 130, the downward load of the table 130 acts as a force of moving the sliding member 143 forward. Therefore, the tip 141*a* of the lock claw 141 is pushed by the engagement wall surface 143*b* of the lock groove 143*a* in the direction of engagement. Further, the front end of the lock claw 141 contacts the underside of the cover plate 151, so that the lock claw 141 is prevented from rotating in the direction of engagement. Specifically, the engagement between the lock claw 141 and the engagement wall surface 143*b* of the lock groove 143*a* is maintained by the downward load of the table 130.

Further, in the workbench 100 according to this embodiment, an auxiliary leg 125 with an adjusting screw shaft 125*a* is provided on the lower end 111*b* side of the first frame 111. In use of the desk circular saw 200 for cutting a workpiece, the auxiliary leg 125 is adjusted in height and grounded after the height of the table 130 is set. In this manner, unwanted movement of the workbench 100 can be prevented. Further, the workbench 100 can be easily moved to change the working site by utilizing the wheel 123 provided on the lower end 113*b* of the second frame 113.

Next, lowering of the table 130 is explained. The user stands on the side facing the handle 101 and pulls the release arm 153. At this time, as mentioned above, the downward load of the table 130 acts in the direction that maintains engagement of the lock claw 141. Therefore, when the release arm 153 is pulled, the rotating shaft 147 does not rotate and the coil spring 157 is deformed by compression. Subsequently, the handle 101 is slightly lifted while the release arm 153 is kept pulled, so that the downward load of the table 130 is released. As a result, the right and left lock claws 141 rotate upward together with the rotating shaft 147 by the restoring force of the elastically deformed coil spring 157. Then the tip 141*a* of each of the lock claws 141 is disengaged from the lock groove 143*a*. Thus, the lock of the table 130 is released. After release of the lock, the table 130 can be lowered down to the lowering end position by lowering the handle 101.

In order to lower the table 130, the table 130 is once lifted, for example, by pulling and lifting the handle 101 while pressing the lower end 111*b* of the first frame 111 with one foot in such a manner as to keep it from moving apart from the ground. Specifically, when the handle 101 is pulled and lifted, the first frame 111 rotates on the lower end 111*b* in the direction of erection. At this time, the second frame 113 rotates on the pivot shaft 115 with respect to the first frame 111 while moving forward on the ground via the wheel 123. Thus, the table 130 can be easily lifted. As described above, according to this embodiment, the workbench 100 can be provided in which the table 130 can be easily raised and lowered in a workplace and which can be easily moved in the workplace.

According to this embodiment, the lock of the table 130 by the lock mechanism 140 can be released by pulling the release arm 153. Thus, the release operation can be easily performed. Further, the release arm 153 extends toward the handle 101 and the extending end in the form of the grip 153*b* is located close to the handle 101. Therefore, the user can pull the grip 153*b* while holding the handle 101 and the grip 153*b* of the release arm 153 at the same time with one hand. Specifically, the user can support the downward load of the table 130 by holding the handle 101 when pulling the release arm 153.

Further, according to this embodiment, the release arm 153 is connected to the rotating shaft 147 that supports the lock claw 141 via the coil spring 157. Therefore, even if the release arm 153 is inadvertently pulled, only the compression deformation of the coil spring 157 is caused and the engagement of the lock claw 141 is not released. Therefore, accidental drop of the table 130 can be prevented. Further, when the table 130 is slightly raised after the release arm 153 is pulled, the engagement of the lock claw 141 is released by restoration of the compressive deformation of the coil spring 157. With this construction, an operation of pulling the release arm 153 can be rendered effective only when the table 130 is intended to be lowered. In order to deform the coil spring 157 by compression when the release arm 153 is pulled, the coil spring 157 is fitted over the extended end of the rod-like portion 153*a* of the release arm 153. With this arrangement, the coil spring 157 is guided by the rod-like portion 153*a*, so that the motion of the coil spring 157 is stabilized.

Further, in this embodiment, the two rod-like portions 153*a* of the release arm 153 extend along the right and left frames 133 of the table 130 between the frames 133. Specifically, the release arm 153 is placed in the free space existing between the right and left frames 133. Thus, the space can be reasonably and effectively utilized. As a result, the table height from the ground can be set to a lower level when the table 130 is in the lowering end position. This is effective in saving space for storing the workbench 100 or for loading it in the back of a vehicle. Further, the release arm 153 is disposed below the upper surface of the table 130, so that the release arm 153 never interferes with operation using the desk circular saw 200 on the table 130.

Further, according to this embodiment, the compression coil spring 161 is disposed between the table 130 and the support leg 110 and serves to assist in raising the table 130 and prevent the table 130 from abruptly lowering. Further, the upward biasing force of the compression coil spring 161 acts upon the table 130 when the table 130 is in a region below the lowest level of the intermediate position. With this configuration, when the table 130 is in the height adjustable range in which the table 130 can be locked by the lock mechanism 140, the biasing force of the compression coil spring 161 does not act. Thus, the effect of the biasing force on the lock of the lock mechanism 140 can be avoided.

Further, in this embodiment, the height of the table 130 can be adjusted in five levels, but the adjustment is not limited to the five levels. Further, in this embodiment, the lock claw 141 is engaged with the lock groove 143*a* from above, but it may be constructed such that the lock claw 141 is engaged with the lock groove 143*a* from below. Further, it may be constructed such that the lock claw 141 and the lock groove 143*a* are horizontally opposed to each other. A power tool to be placed on the workbench 100 is not limited to the desk circular saw 200, but any stationary power tool can be placed.

Further, in this embodiment, the lock releasing member for releasing the lock claw 141 is formed by the release arm 153 comprised of a single member, but it may be formed by several members in combination. Further, the rod-like portions 153*a* of the release arm 153 of the lock release member may comprise a wire rope or any other elongated element extending along the underside of the table 130 toward the handle 101.

Further, the elastic element in the form of the coil spring 157 for transmitting the motion of the release arm 153 when the release arm 153 is pulled, may be of the tension type in place of the compression type. Alternatively, rubber may be used instead of the spring. Further, in this embodiment, the handle 101 and the grip 153*b* of the release arm 153 are disposed close enough to each other to be held at the same time with one hand of the user. However, the handle 101 and the grip 153*b* may be more widely spaced apart from each other such that the handle 101 can be held with one hand and the grip 153*b* of the release arm 153 can be held with the other.

Description of Numerals

100 workbench
101 handle
110 support leg
111 first frame (first support leg)
111*a* upper end
111*b* lower end
113 second frame (second support leg)
113*a* upper end

113*b* lower end
115 pivot shaft (shaft)
117 connecting rod
119 upper pivot shaft
121 upper pivot shaft
123 wheel
123*a* axle
125 auxiliary leg
125*a* adjusting screw shaft
130 table
131 plate
133 frame
133*a* extension
135 mounting hole
140 lock mechanism
141 lock claw (engaging member)
141*a* tip
143 sliding member (movable element)
143*a* lock groove (engagement recess)
143*b* engagement wall surface
145 guide rod
147 rotating shaft
147*a* plate
149 torsion spring (elastic member)
151 cover plate
151*a* bolt
153 release arm (lock release member)
153*a* rod-like portion (elongated element)
153*b* grip
155 ring
157 coil spring (elastic element)
161 compression coil spring (biasing member)
163 cylindrical member
163*a* spring receiver
163*b* spring receiver
165 hook
167 pin
169 auxiliary stand

The invention claimed is:

1. A workbench for a power tool comprising:

a table on which the power tool is placed;

a first support leg having an upper end rotatably mounted on one end side of the table and a lower end, the first support leg extending downward toward an other end side of the table from the upper end to the lower end;

a second support leg having an upper end and a lower end, the upper end being mounted on the other end side of the table in such a manner as to be horizontally movable with respect to the table, the second support leg extending downward toward the one end side of the table from the upper end to the lower end and intersecting with the first support leg:

a shaft that rotatably connects intersections of the first and second support legs:

a handle held by a user of the workbench, the handle being disposed on the other end side of the table, wherein, when the user of the workbench raises or lowers the handle, the first and second support legs rotate on the shaft, so that the table is moved vertically between a lower position of a predetermined height and a upper position higher than the lower position, while horizontally moving with respect to the upper end of the second support leg, wherein the handle is slidably and pivotally connected to the table when the user of the workbench pulls the handle away from the table and raises or lowers the table;

a lock mechanism comprising:

at least one of a plurality of grooves that prevents the upper end of the second support leg and the table from moving with respect to each other in a direction to lower the table when the table is moved between the lower position and the upper position to lock the table in the upper position;

a movable element that moves horizontally together with the upper end of the second support leg;

an engaging member rotatably mounted on the table and facing the movable element;

an upper position engagement recess that is formed in the movable element and engaged with the engaging member when the table is placed in the upper position;

at least one intermediate position engagement recess that is formed in the movable element and engaged with the engaging member when the table is placed in an intermediate position between the upper position and the lower position; and an elastic member that applies a biasing force to the engaging member in a direction of engagement of the engaging member with the at least one intermediate position engagement recess or the upper position engagement recess; and a lock release member that releases the table locked by the lock mechanism, wherein the lock release member includes an elongated element disposed below the upper surface of the table and extending along the table toward the handle, and the lock mechanism is released when the user pulls the elongated element in the longitudinal direction of the elongated element away from and out of the at least one of the plurality of grooves, wherein, when the table is placed in the upper or intermediate position, the engaging member is rotated toward the movable element by the biasing force of the elastic member and is engaged with the upper position engagement recess or the intermediate position engagement recess, thereby locking the upper end of the second support leg and the table against relative movement with respect to each other, and when the engaging member is rotated away from the movable element by the pulling operation of the lock release member, the engaging member is disengaged from the upper position engagement recess or the intermediate position engagement recess, thereby releasing the lock mechanism.

2. The workbench as defined in claim 1, wherein:

when the table is placed in the upper or intermediate position, a weight of the table acts in a direction that keeps the engaging member engaged with the upper position engagement recess or the at least one intermediate position engagement recess, the engaging member and the elongated element are connected to each other via an elastic element, the elastic element elastically deforms when the elongated element is pulled by the user with the en a in member engaged with the upper position engagement recess or the at least one intermediate position engagement recess, thereby allowing the operation of pulling the elongated element while maintaining the engagement of the engaging member with the engagement recess, and when the weight of the table is released, the elastic element is restored to its original state in which the elastic element is not subjected to elastic deformation, thereby disengaging the engaging member from the upper position engagement recess or the at least one intermediate position engagement recess.

3. The workbench as defined in claim 2, further comprising a biasing member that applies an upward biasing force to the table, wherein the biasing member is disposed between the table and the first or second support leg or between the first support leg and the second support leg and arranged such that the biasing member is held under load conditions in which the biasing member is acted upon by a downward load of the table when the table is located below the intermediate position, while the biasing member is held under no-load conditions in which the biasing member is not acted upon by the downward load of the table when the table is located between the intermediate position and the upper position.

4. The workbench as defined in claim 1, wherein the elongated element extends in a direction of pulling operation and a grip to be held by the user is formed on an extending end of the elongated element and extends in a direction that intersects with an extending direction of the elongated element.

5. The workbench as defined in claim 4, wherein the grip is located in a vicinity of the handle such that the user is able to hold the handle and the grip at a same time with one hand.

6. The workbench as defined in claim 2, wherein the elastic element is fitted over the elongated element with one end held in contact with the elongated element and the other in contact with the engaging member.

7. The workbench as defined in claim 3, wherein the biasing member comprises a compression coil spring disposed between the table and the first or second support leg and wherein, when the table is located below the intermediate position, ends of the coil spring contact the table and the first or second support leg respectively so that the coil spring is compressed, while, when the table is placed between the intermediate position and the upper position, at least one of the ends of the coil spring is disengaged from the associated table or the associated first or second support leg so that the coil spring is held in a free state.

* * * * *